United States Patent [19]

Suh et al.

[11] 4,270,951

[45] Jun. 2, 1981

[54] SINTERING OF COATED BRIQUETTE

[75] Inventors: Sang K. Suh, Livonia; Daniel W. Hall, Dearborn Heights, both of Mich.

[73] Assignee: Ford Motor Company, Dearborn, Mich.

[21] Appl. No.: 967,926

[22] Filed: Dec. 8, 1978

[51] Int. Cl.[3] ..... B22F 3/00

[52] U.S. Cl. ..... 75/200; 75/226

[58] Field of Search ..... 75/200, 226

[56] References Cited

U.S. PATENT DOCUMENTS 4,006,016 2/1977 Zambrow et al. ..... 75/200

OTHER PUBLICATIONS

Wick, Mach & Production Engr., vol. 117, 10-21-70, "Forging Gears from Powder Metal Preforms," pp. 668-670.

Hirschorn et al., Metal Forming, Nov. 1970, vol. 37, #11, "The Forging of Powder Metallurgy Preforms," pp. 320-327.

Metal Progress, Apr. 1971, vol. 99, #4, pp. 54-60, "Where Powder Metallurgy is Growing".

*Primary Examiner*—Brooks H. Hunt

*Attorney, Agent, or Firm*—Joseph W. Malleck; Olin B. Johnson

[57] ABSTRACT

A method of making sintered powder metal parts which particularly includes a hot forging step, is disclosed. Selected powders of a predetermined particle size distribution, are blended and agglomerated by cold compaction into a preform. The preform or briquette is then coated with a thin shell of a chemically inactive radiation absorbing material, preferably graphite, under ambient conditions. The coated briquette is then sintered in a continuous through-put furnace with the temperature maintained at a level of at least 2000° F. and the part being subjected to the furnace heating for a period of 5-30 minutes. The sintered part may then be subjected to direct hot forging with the retained temperature of sintering utilizing the graphite coating as a die lubricant, or the sintered part may be cooled and then subsequently reheated for hot forging, again utilizing the retained graphite coating as a die lubricant. If hot forging is not to be employed, the graphite particles are removed such as by brushing so that sizing, machining or grinding may be carried out without the presence of the graphite coating.

7 Claims, No Drawings

SINTERING OF COATED BRIQUETTE

BACKGROUND OF THE INVENTION

Current methods of making powdered metal parts which require hot forming as an integral step thereof, generally require in sequence (a) cold compacting (briquetting) to a density of about 85%, (b) sintering at a high temperature to further increase the density to about 88%, (c) hot coating of a lubricant on the exterior of said compact, usually carried out at a temperature of about 1800° F., and (d) hot forging or hot forming the coated compact, at a temperature level of about 1800° F. with applied pressure in the range of 75 tons per square inch. The compacts are heated in most commerical sintering operations in furnaces which apply the heat by radiation from glowing heating elements. The rate of radiation absorption is governed considerably by the surface condition of the compacts, particularly the color.

Two important problems arise in connection with the accepted method sequence, the first of which relates to the deficiency in time for heating the compact. The time for heating relatively bright and shiny powder compacts, which have been briquetted, is inordinately long, requiring slow belt speeds for carrying the compacts through a continuous sintering furnace. This is inefficient. Secondly, the compacts require a lubricant to facilitate subsequent hot forging under pressure. Lubricants have been applied in the form of dark coatings, typically graphite, but consistently subsequent to sintering and at an elevated temperature level making the coating of such lubricant extremely difficult. The lubricant coating selected has been active graphite or a mixture thereof. Contamination of the iron compact would occur if the active graphite coating were to be applied prior to sintering.

These past sintering lubricant coatings have been applied at two temperature levels, one where the sintered compact has been allowed to be cooled, then reheated to permit the application of the lubricant at a temperature, preferably about 400° F.; then reheated to a required forging temperature, and subjected to hot forming. The other is to take the compact directly from a sintering operation, coat it at the extremely high temperature as it is received from the sintering furnace, and then directly transfer the compact to a hot forging machine.

Both of these alternative procedures do little to promote heating efficiency and make it easier to apply the lubricant. The present invention proposes that a thin, radiation of heat absorbing, shall be applied to the compact under ambient or cold conditions to serve two purposes: (a) to facilitate and increase the efficiency of heat absorption during sintering, and to provide an inherent lubricating coating which retains its character through the hot forming step.

Graphite coatings have been used heretofore in the powder metallurgy art, but limited to their use as a mold coating or a mold medium for carrying out heating to exclude oxidation. For example, in U.S. Pat. No. 3,305,358 several stucco coating layers are applied to a mold in relatively thick amounts. Powdered materials are placed therein and then the assembly is subjected to impact or pressure within the mold. Graphite is used in the relatively thick stucco layering as a mechanism for eliminating die wear; the graphite is not effective to increase heat absorption by radiation from a surrounding space.

In U.S. Pat. No. 3,853,550, a graphite medium was employed within a mold into which a compacted metal object was placed, the graphite layers being at least 1–2 centimeters thick. The use of the graphite medium was to exclude air while the vessel was placed in an air environment for heating. Heating efficiency is not improved; radiant energy must pass through the metal vessel walls and then through the relatively thick graphite medium before effecting a temperature increase in the powder metal part. The thickness and location of the graphite medium is critical to determining whether it acts as an assist to improve heating efficiency or serves as a detriment to heating efficiency.

SUMMARY OF THE INVENTION

A primary object of this invention is to provide an improved method of making powder metal parts to achieve higher productivity at lower energy costs and without affecting the quality of the parts thereof.

Another object of this invention is to provide an improved method of making powder metal parts which require a subsequent hot forming operation, the improvement residing in the elimination of a hot forming lubricant applied under heated temperature conditions.

Features pursuant to the above objects comprise: (a) the use of a thin radiation absorbing coating which serves also additionally as a lubricant for a hot forming operation, the coating being applied under ambient temperature conditions, (b) the coating is preferably comprised of graphite acting as a dark radiation absorbing film which changes the surface character of the cold compact without affecting energy transmission thereinto, (c) employing a continuous furnace of the radiant energy type wherein precompacted powdered parts can be continuously conveyed through said furnace at an increased belt speed, (d) the precoated compact is subjected to a sintered temperature of at least 2000° F. for a period of time limited to 5–30 minutes, and (e) the sintered part can be directly transferred to a forging step without the necessity for a hot lubricant application or can be cooled and reheated to forging temperatures again without the necessity for a warm or hot lubricant coating step.

DETAILED DESCRIPTION

There are essentially two broad categories or modes by which parts are made with powder metallurgy techniques. The first generally referred to as conventional powder metallurgy; it is a process for producing metal parts by blending powders, compacting the cold mixture to the required contour and then sintering or heating them in a controlled atmosphere to bond the contacting surfaces of the particles and obtain the desired properties in the part. Some parts are subsequently sized, coined or repressed, impregnated with oil or plastic, infiltrated with a lower melting metal or alloy, heat treated, plated, or subjected to other such treatments. While the process would appear to be basically simple, the technique in fact is complex and requires an experienced technical specialist coupled with a substantial capital investment to produce parts having optimum performance characteristics. For many years the conventional metallurgy process has been utilized to make structural components having adequate tensile and yield strengths. However, their impact and fatigue properties fall short of forged levels, the primary reason being the 10–25% voids in the powder metallurgy component. The detrimental effect of these voids on mechanical properties has been partially overcome by repressing and/or infiltration. But the additional processes are expensive and the improvement in properties by using them is not enough to compete in critical applications with forged materials. It is necessary therefore to eliminate porosity to realize the full potential of metal powder components.

Accordingly, the second major mode has been developed which is called powder metallurgy forging. The process involves basically five steps; selecting and blending the powders, preforming the powders into a shape that is useful for forging or for handling, sintering, forging or hot pressing. Depending upon the application, the actual forging step can be done cold (less than 500° F.), warm (1000°–1200° F.). Powder metallurgy forging offers broad flexibility because it can provide components in densities ranging from greater than that achieved by conventional powder metallurgy methods to the "full" density of conventional cast or forged materials.

This invention is particularly concerned with improving the powder metallurgy forging mode, although it can be applied secondarily to improving the conventional powder metallurgy technique.

The following is a preferred method for carrying out the present invention:

(1) Blending or mixing of powders—Raw materials consist of accurately controlled, high purity, fine particle size metal powders of proper shape and size distribution. Metal powders usable include copper, iron, tin, lead and nickel, as well as prealloyed powders of brass, bronze, nickel, silver, and a number of steel alloys including stainless steel. The purity of the raw materials is of some importance because they affect the dynamic properties of the part. The impurities in the powder source itself must be controlled and secondly the impurities that may be introduced during the manufacturing process must also be limited. To this extent, impurities should be limited to about 1%. The particle size required is usually in the range of 80 to 325 mesh (180 to 40 microns). A typical particle size distribution for a charge would consist of 0.1% 80 mesh, 6.9% 100 mesh, 17% 150 mesh, 20% 200 mesh, 6% 250 mesh, 20% 325 mesh and 30% less than 325 mesh.

The powders are carefully weighed to correct proportions required for a particular composition; die lubricants and graphite additives are then added and thoroughly mixed into a homogeneous blend.

(2) Preform making—The blended and mixed powder supply is then preferably cold compacted to a desired preform configuration. This is typically carried out by feeding the powder blend into a precision die and compressed by means of lower and upper punches to a desired shape and size. The dies are usually mounted in either mechanical or hydraulic presses. The compacting pressures range from about 10 to 100 tons per square inch, depending on the type of material being pressed and the density required.

The kind of preform made will depend upon the type of forging process to be used. If no flash is desired in the final forging, careful weight control must be maintained. The design of the preform is determined by the degree of deformation required during the forging step and by considerations of die wear. The manufacture of the preform is not necessarily limited to cold die compaction, typical of powder metallurgy parts, but temperatures up to 400° F. may be employed which promote a liquid phase during compaction (which hereinafter is referred to as warm briquetting). Furthermore, isostatic compaction may be employed which offers other possibilities, since there is no need to admix a lubricant for the compaction step.

Preform density is a prime variable in the forging process. The greater the preform density, the easier it is to protect it from oxidation during processing and the smaller the degree of deformation it requires to reach the given density. For purposes of this invention, the preform density should be in the range of 6.7 to 7.0 grams per cubic centimeter.

(3) Cold coating—The preform or compacted powdered part is then coated with a thin shell of a chemically inactive radiation absorbing material. This is preferably in the form of inactive graphite which is brushed or sprayed on the preform or the preform may be dipped in a graphite suspension. The thickness of the coating must not be in excess of 0.02 inches and not less than 0.001 inches. Another material that may be employed for the thin radiation absorbing coating includes $MoS_2$ which may be blended with graphite; it is stable at sintering temperatures and is black. The particle size of the graphite medium should be in the range of 2 to 75 microns so that a thin coating can be maintained.

(4) Sintering—The parts are sintered by being passed through a controlled, protective atmosphere furnace of the radiant energy type maintained at a temperature of about one third below the melting point of the principal constituent. The sintering atmosphere and temperature permits particle bonding and recrystalization to take place across the particle interfaces. In the case of iron-carbon parts, the sintering atmosphere must be carefully controlled to ensure the desired combined carbon content. Sintering will take place if one of the constituents is liquid at the sintering temperature, or without any liquid constituents, as in the case with pure iron powder parts. In either case, the sintering operation bonds the powder particles together to produce a homogeneous part having the desired physical properties. The color of the part surface affects the temperature history of the parts as they pass through the various temperature zones of a continuous sintering furnace. The darker the surface, the faster will be the heat-up rate and under given furnace conditions the higher will be the maximum temperature the parts will reach. By darkening the surface of the part to be sintered, the belt, supporting and conveying the preform parts through the furnace, can be increased in speed and thereby achieve higher productivity and reduced energy expenditure for each individual part without affecting part quality. Conversely, facility cost and floor space can be reduced when purchasing new sintering facilities.

(5) Steps subsequent to sintering can fall into one of two avenues for forging the first of which is to take the sintered part in its hot condition directly to hot forming or hot forging. The other method is to allow the sintered part to cool and then be reheated at some convenient time for purposes of hot forming and hot forging. Within the frame work of each of these temperature controls for forging, the part itself may be subjected either to a hot repressing step which involves very little flow of the powder material to achieve the final configuration, or a closed die forging which may be employed to provide controlled flash, or a confined die which results in very little or no flash but is accompanied by extensive or considerable flow of the material.

Regardless of the degree of forging pressures that are applied and the degree of material flow during such forging, a lubricant is necessary to limit die wear. The graphite coating applied prior to sintering and which remains intact on the sintered part serves as such lubricant in the quantities so applied. Accordingly, prior art intermediate steps of hot coating of a lubricant following sintering or a warm lubricant coating following reheating can be eliminated.

Test data to determine the effect of the surface color of a preform or briquette was generated in a belt type furnace (of the Drever type). Two sets of iron powder samples (each having a 3" diameter and a 2.5" length), one with an as-compacted bright surface and the other with a graphite coated dark surface, were sintered at 2050° F. The one containing the bright surface resulted from the use of a powder metal consisting of 0.5% Mo, 0.20% Mn, 1.85% Ni balance iron having a particle size averaging about 100 microns. Inactive graphite was employed to provide a dark coated surface; the graphite had a particle size of about 20 microns and was applied in a coating thickness of 0.005 inches. The temperature variations of the samples during sintering were recorded with thermocouples embedded in the center of the samples. Graphite coating remained on the surface after sintering. The results of the experiments are in the following table:

| | | No Coating | Graphite Coating |
|---|---|---|---|
| Belt speed: | Max Temp. Attained | 1200° F. | 1540° F. |
| 6"/min. | Time above 1115° F. | 5 min. | 11.5 min. |
| Belt speed: | Max Temp. Attained | 1667° F. | 1862° F. |
| 3"/min. | Time above 1547° F. | 5 min. | 9 min. |

If hot forging is not to be employed and machining, grinding, or sizing is to be carried out, the carbon coating can be removed by brushing or tumbling prior to such operations.

We claim:

1. A method of making sintered powder metal parts from selected metal powders having a predetermined size, comprising:

(a) after having compacted the powder into a preform at substantially ambient temperature conditions, coating said preform with a thin shell of a chemically inactive radiation absorbing material under ambient conditions, (b) sintering said coated preform in a furnace chamber by predominantly radiation heating.

2. The method as in claim 1, in which the sintered preform is subjected directly to a hot forming operation following said sintering, with the retained heat of said sintering being employed, said hot forming being carried out under a pressure of 75 tons per square inch, and said radiation absorbing material having lubricating qualities to facilitate said hot forming.

3. The method as in claim 1, in which said radiation absorbing material is comprised of inactive graphite.

4. The method as in claim 1, in which said sintered preform is permitted to cool subsequent to said sintering operation and is then reheated to a temperature level of 1800° F., and subjected to a hot forming or forging operation, said radiation absorbing material being constituted of graphite so as to serve as a die lubricant during the hot forming operation.

5. The method as in claim 1, in which the thickness of said thin shell is in the range of 0.001 to 0.002 inches.

6. The method as in claim 1, wherein following the sintering of said coated preform, the radiation absorbing material is brushed off permitting said sintered preform to be sized, machined or ground without the interference of said coating on the surface thereof.

7. A method as in claim 1 in which said furnace chamber is maintained at a temperature of 2000° F. or greater for a period of 5–30 minutes.

* * * * *